US010954704B2

(12) United States Patent
Kroening

(10) Patent No.: US 10,954,704 B2
(45) Date of Patent: Mar. 23, 2021

(54) DOOR STOP MECHANISM FOR HOLDING A DOOR OF AN ENCLOSURE IN AN OPEN POSITION

(71) Applicant: Greenlee Tools, Inc., Rockford, IL (US)

(72) Inventor: John Wayne Kroening, Machesney Park, IL (US)

(73) Assignee: GREENLEE TOOLS, INC., Rockford, IL (US)

( * ) Notice: Subject to any disclaimer, the term of this patent is extended or adjusted under 35 U.S.C. 154(b) by 603 days.

(21) Appl. No.: 15/247,235

(22) Filed: Aug. 25, 2016

(65) Prior Publication Data

US 2018/0058119 A1 Mar. 1, 2018

(51) Int. Cl.

| | |
|---|---|
| ***E05C 17/16*** | (2006.01) |
| ***B25H 3/02*** | (2006.01) |
| ***E05C 17/20*** | (2006.01) |
| ***E05C 17/00*** | (2006.01) |

(52) U.S. Cl.

CPC ..... *E05C 17/16* (2013.01); *B25H 3/02* (2013.01); *E05C 17/00* (2013.01); *E05C 17/166* (2013.01); *E05C 17/20* (2013.01); *Y10S 292/14* (2013.01); *Y10S 292/15* (2013.01); *Y10T 292/0963* (2015.04); *Y10T 292/28* (2015.04); *Y10T 292/285* (2015.04); *Y10T 292/286* (2015.04); *Y10T 292/289* (2015.04); *Y10T 292/291* (2015.04); *Y10T 292/34* (2015.04); *Y10T 292/65* (2015.04)

(58) Field of Classification Search

CPC . Y10T 292/28; Y10T 292/285; Y10T 292/34; Y10T 292/65; Y10T 292/0963; Y10T 292/286; Y10T 292/291; Y10T 292/289; B62D 33/03; E05C 17/16; E05C 17/166; E05C 17/00; E05C 17/20; B25H 3/02

USPC ..... 292/DIG. 15, 262, 265, 288, 338, 292/DIG. 14, 158

See application file for complete search history.

(56) References Cited

U.S. PATENT DOCUMENTS

| | | | | |
|---|---|---|---|---|
| 179,308 A * | 6/1876 | Hill | E05C 17/166 292/269 |
| 185,466 A | 12/1876 | Whipple | |
| 902,730 A | 11/1908 | Hill | |
| 906,514 A * | 12/1908 | Dengler | E05C 17/30 292/268 |
| 1,446,866 A * | 2/1923 | Winans | E05C 17/16 292/17 |

(Continued)

*Primary Examiner* — Kristina R Fulton
*Assistant Examiner* — Faria F Ahmad
(74) *Attorney, Agent, or Firm* — Klintworth & Rozenblat IP LLP

(57) ABSTRACT

An assembly according to some embodiments of the disclosure includes an enclosure having a housing and door hingedly attached to the housing and a door stop mechanism which holds the door in an open position. The mechanism includes a link member pivotally connected to the door and to the housing. The link member has an elongated slot which extends along a portion of the link member. The slot has a linear portion and an enlarged opening at an end thereof which is offset from the linear portion. When the door is opened, a fastener, which is either mounted to the housing or to the door, slides along the slot until the fastener is positioned in the enlarged opening to hold the door open.

22 Claims, 5 Drawing Sheets

(56) References Cited

U.S. PATENT DOCUMENTS 1,563,606 A * 12/1925 Williams ..... E05C 17/16 296/96.21
1,603,581 A * 10/1926 Campbell ..... E05C 17/16 292/262
1,636,468 A * 7/1927 Ferris ..... E05C 17/28 292/273
1,722,736 A * 7/1929 Derbyshire ..... E05C 17/166 292/268
1,743,379 A * 1/1930 Newren ..... E05C 17/28 292/272
1,743,654 A * 1/1930 Bristol ..... E05C 17/16 292/270
1,748,196 A * 2/1930 Stevenson ..... E05C 17/16 16/345
1,753,542 A * 4/1930 Welna ..... E05C 17/16 292/268
1,767,463 A * 6/1930 Ledwinka ..... E05C 17/16 296/96.2
1,836,918 A * 12/1931 Hammer ..... E05C 17/16 16/82
1,862,868 A * 6/1932 Sukoff ..... A45C 13/34 16/337
1,960,024 A * 5/1934 Paris ..... E05C 17/16 292/265
1,986,307 A * 1/1935 Wagner ..... A45C 13/34 217/60 C
2,020,014 A 11/1935 Boenning
2,076,860 A * 4/1937 North ..... E05C 17/085 217/60 C
2,175,861 A * 10/1939 Wall ..... E05C 17/24 292/265
2,369,136 A 11/1941 Chambers et al.
2,417,401 A 12/1944 Steinhorst
2,505,320 A 4/1950 Bernhard
2,550,008 A * 4/1951 Freeman ..... E05C 17/085 217/60 R
2,587,200 A * 2/1952 Nottingham ..... E05C 17/20 217/60 C
2,723,776 A * 11/1955 Jacobson ..... A45C 13/34 188/67
2,773,278 A * 12/1956 Atwood ..... E05C 17/16 16/327
2,801,871 A * 8/1957 Radcliffe ..... E05C 17/166 292/267
2,842,278 A * 7/1958 Murphy ..... E05C 17/16 217/60 D
2,857,617 A * 10/1958 Loria ..... E05C 17/16 16/85
2,873,470 A * 2/1959 De Dona ..... E05C 17/16 16/333
2,905,965 A * 9/1959 Flint ..... E05C 17/16 16/49
2,923,506 A * 2/1960 Simons ..... A47B 67/005 248/201
3,103,692 A * 9/1963 Ruck, Jr. ..... E05C 17/16 16/49
3,337,253 A * 8/1967 Laukzemis ..... A45C 13/34 217/60 R
3,369,833 A * 2/1968 Schaldenbrand ..... E05C 17/16 16/82
3,980,331 A 9/1976 Kennedy et al.
4,080,758 A * 3/1978 Hubbard ..... E05C 17/163 292/262
4,119,336 A * 10/1978 Sparrevohn ..... E05C 17/166 292/268
4,143,904 A * 3/1979 Cooper ..... E05F 1/123 292/DIG. 29
4,181,334 A * 1/1980 Fusi ..... E05B 83/16 292/262
4,348,045 A * 9/1982 Hori ..... B62D 33/0273 296/14
4,624,492 A 11/1986 Vidas
4,714,286 A * 12/1987 Yamamoto ..... A45C 5/00 292/252
4,790,581 A * 12/1988 Boswell ..... E05C 17/163 292/262
4,846,514 A * 7/1989 Flynn ..... E05C 17/166 292/268
4,852,921 A * 8/1989 Gilbert ..... E05C 19/003 292/259 R
4,858,952 A * 8/1989 Sasaki ..... E05C 17/206 280/802
5,244,273 A * 9/1993 Kaspar ..... E05C 17/16 16/82
5,299,469 A * 4/1994 Meyer ..... F16C 7/06 403/104
5,353,660 A * 10/1994 Heck ..... B60H 1/00857 16/82
5,549,051 A * 8/1996 Zimmerman ..... A47B 1/04 108/80
5,588,259 A * 12/1996 Kolefas ..... E05C 17/16 292/268
6,048,018 A * 4/2000 Shambeau ..... B62D 33/03 296/26.03
6,176,040 B1 * 1/2001 Sugihara ..... E05C 17/206 16/86 C
6,292,978 B1 9/2001 Lakoduk et al.
6,370,732 B1 * 4/2002 Yezersky ..... E05C 17/203 16/82
7,377,561 B2 * 5/2008 Shin ..... E05B 83/24 292/262
7,494,195 B2 * 2/2009 Han ..... H02G 3/081 312/223.2
7,497,490 B2 * 3/2009 Yamaguchi ..... E05C 17/30 292/259 R
7,926,603 B2 * 4/2011 Bonsen ..... B62D 25/12 180/69.21
8,235,480 B2 * 8/2012 Kang ..... F25D 23/028 312/405
8,776,315 B2 * 7/2014 Wach ..... E05F 5/02 16/82
10,081,303 B1 * 9/2018 Ngo ..... B62D 33/03
2006/0082164 A1 * 4/2006 Shin ..... B62D 25/12 292/262
2006/0125270 A1 * 6/2006 Madlinger ..... B62D 33/03 296/57.1
2006/0279184 A1 * 12/2006 Chen ..... G06F 1/181 312/223.2
2015/0184436 A1 * 7/2015 Caruso ..... E05C 19/005 292/338

* cited by examiner

DOOR STOP MECHANISM FOR HOLDING A DOOR OF AN ENCLOSURE IN AN OPEN POSITION

FIELD OF THE DISCLOSURE

The present disclosure relates to a door stop mechanism for an enclosure that holds a door of the enclosure in an open position. More particularly, the present disclosure relates to a door stop mechanism for a metal storage box, often called a job storage box or a cabinet box, that holds a door of the metal storage box in an open position.

BACKGROUND

Enclosures used in outdoor applications often require a positive mechanical stop for holding a door of the enclosure open. If the door is not balanced or if it is outside and subject to wind, the door may swing shut unless the door is held open. The interior of the enclosure should be easily accessible for maintenance, repair or other work that requires the door to be positively held open for extended periods of time. This allows worker to access the interior of the enclosure without having to hold the door open, thereby allowing the worker greater flexibility and improved safety and efficiency.

SUMMARY

An assembly according to some embodiments of the disclosure includes an enclosure having a housing and door hingedly attached to the housing and a door stop mechanism which holds the door in an open position. The mechanism includes a link member pivotally connected to the door and to the housing. The link member has an elongated slot which extends along a portion of the link member. The slot has a linear portion and an enlarged opening at an end thereof which is offset from the linear portion. When the door is opened, a fastener, which is either mounted to the housing or to the door, slides along the slot until the fastener is positioned in the enlarged opening to hold the door open.

This Summary is provided merely for purposes of summarizing some example embodiments so as to provide a basic understanding of some aspects of the disclosure. Accordingly, it will be appreciated that the above described example embodiments are merely examples and should not be construed to narrow the scope or spirit of the disclosure in any way. Other embodiments, aspects, and advantages of various disclosed embodiments will become apparent from the following detailed description taken in conjunction with the accompanying drawings which illustrate, by way of example, the principles of the described embodiments.

BRIEF DESCRIPTION OF THE DRAWINGS

The organization and manner of the structure and operation of the disclosed embodiments, together with further objects and advantages thereof, may best be understood by reference to the following description, taken in connection with the accompanying drawings, which are not necessarily drawn to scale, wherein like reference numerals identify like elements in which.

DETAILED DESCRIPTION

Figure 1:
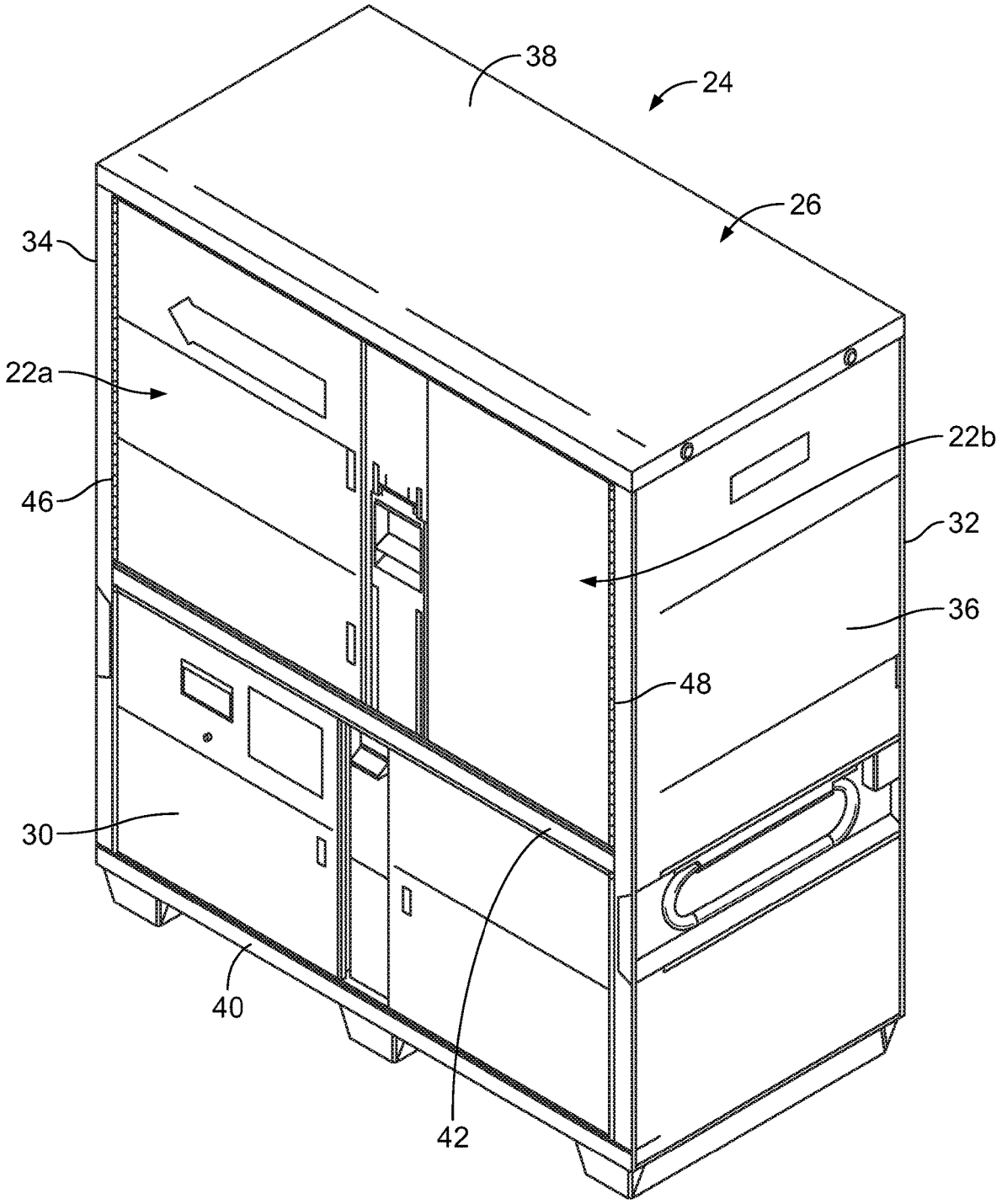
FIG. 1 is a perspective view of an enclosure having a door stop mechanism, and with the doors of the enclosure in a closed position.

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

A door stop mechanism 20 for holding a door 22*a*, 22*b* of an enclosure 24 in an open position is provided. For purposes of illustrative example, embodiments of the door stop mechanism 20 of the present disclosure may be applied to doors 22*a*, 22*b* of an enclosure 24. The enclosure 24 may comprise a job storage box or cabinet box, which is commonly used for the storage of tools and/or other items on a construction site or elsewhere. It will be appreciated that illustration and description of the enclosure 24 is provided as a contextual example of an enclosure in which embodiments of the door stop mechanism 20 may be applied, and not by way of limitation. In this regard, embodiments of the door stop mechanism 20 may be applied mutatis mutandis to any enclosure having one or more doors, including to other types of enclosures (e.g., enclosures serving purposes other than as job storage boxes or cabinet boxes) as well as enclosures having alternative form factors and structural arrangements (e.g., enclosures having different dimensional proportions and/or alternative selection and arrangements of doors, drawers, and/or other features) within the scope of the disclosure.

Figure 2:
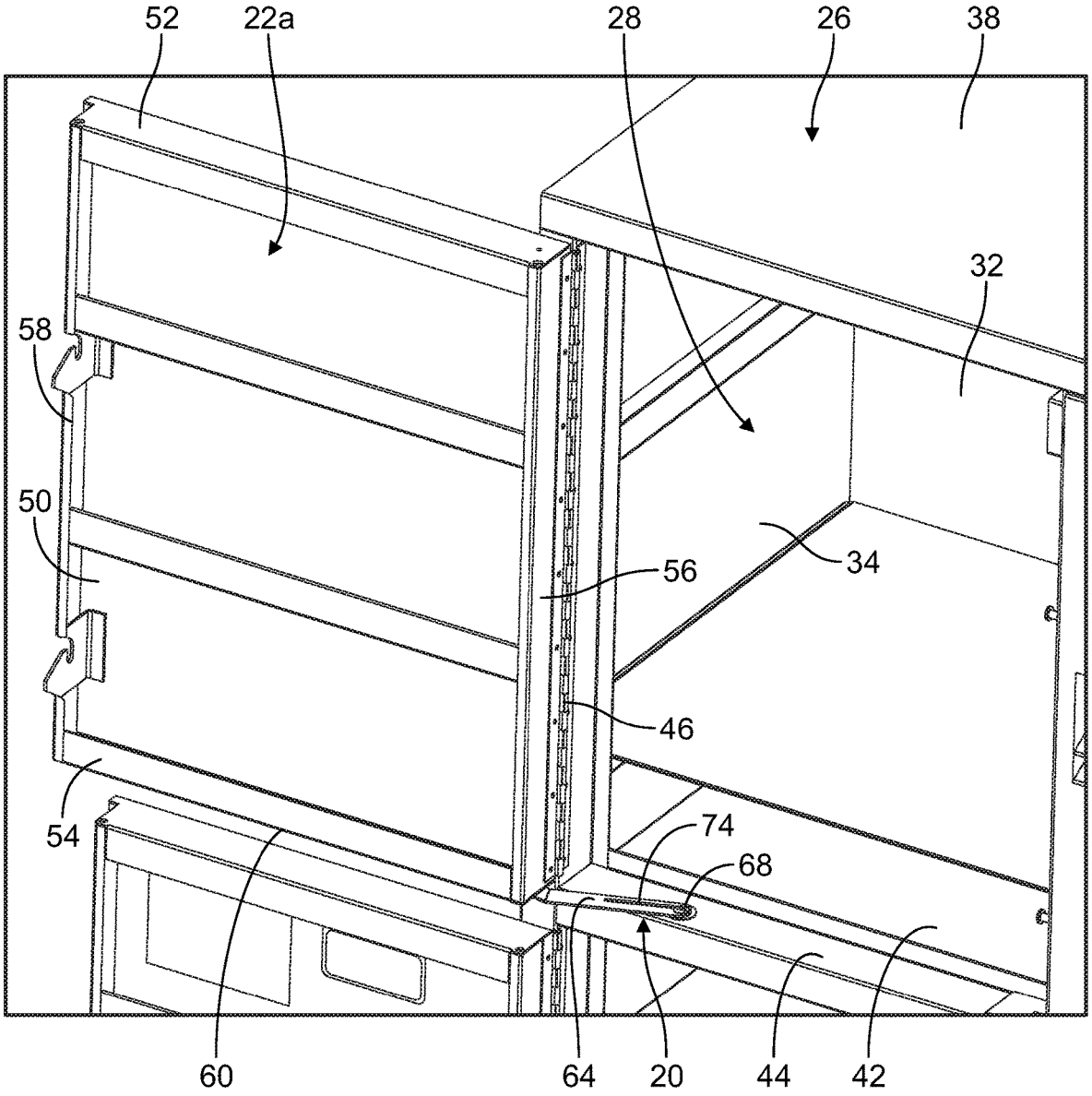
FIG. 2 is a partial perspective view of the enclosure, with a door of the enclosure in an open position.
Figure 3:
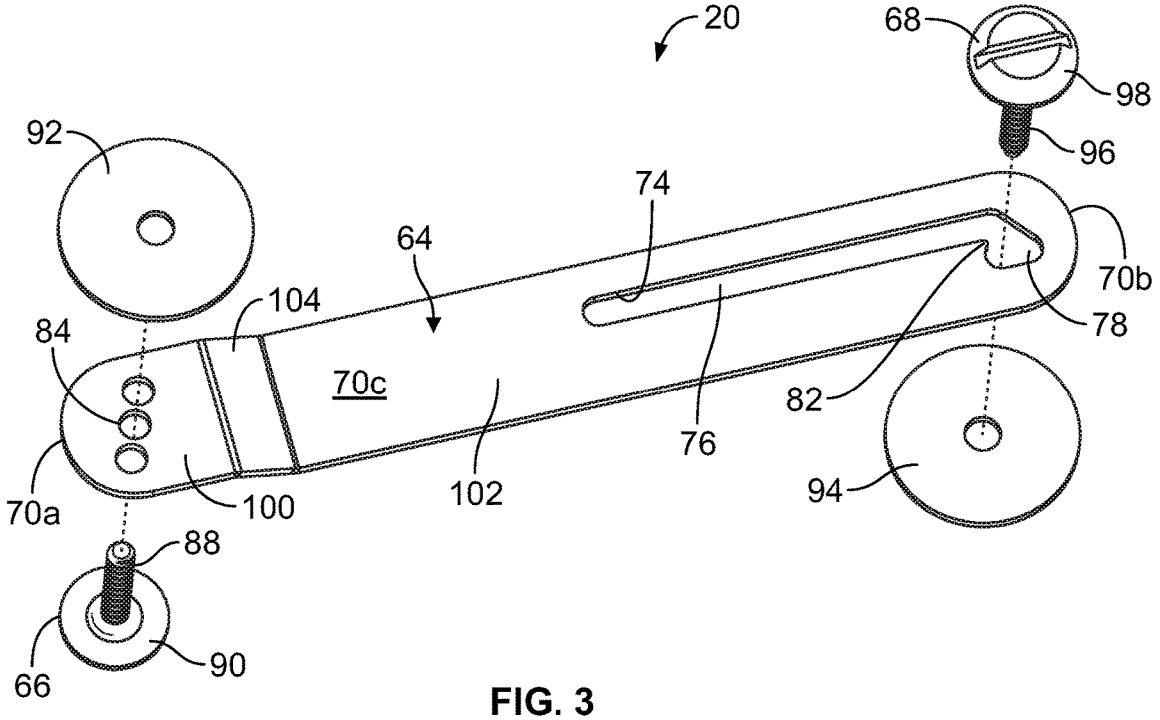
FIG. 3 is a perspective view of the components of the door stop mechanism.
Figure 4:
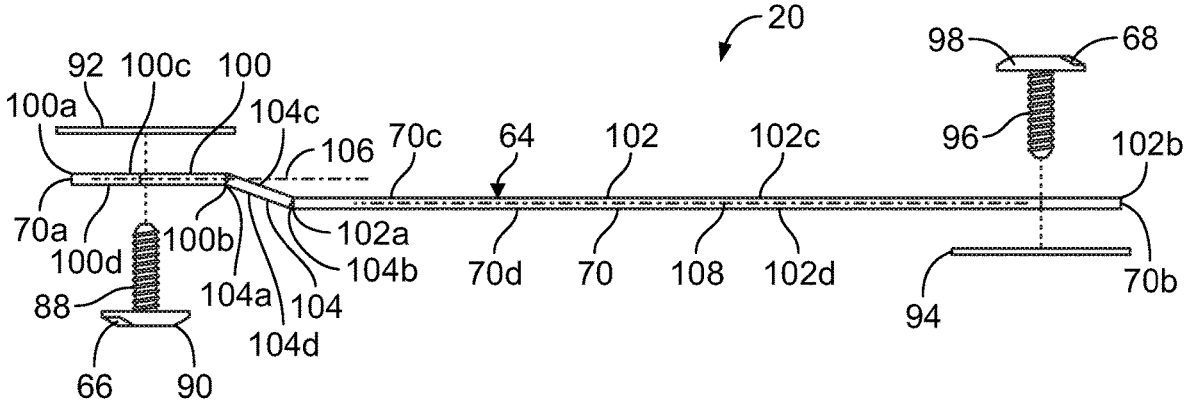
FIG. 4 is a side elevation view of the components of the door stop mechanism.
Figure 5:
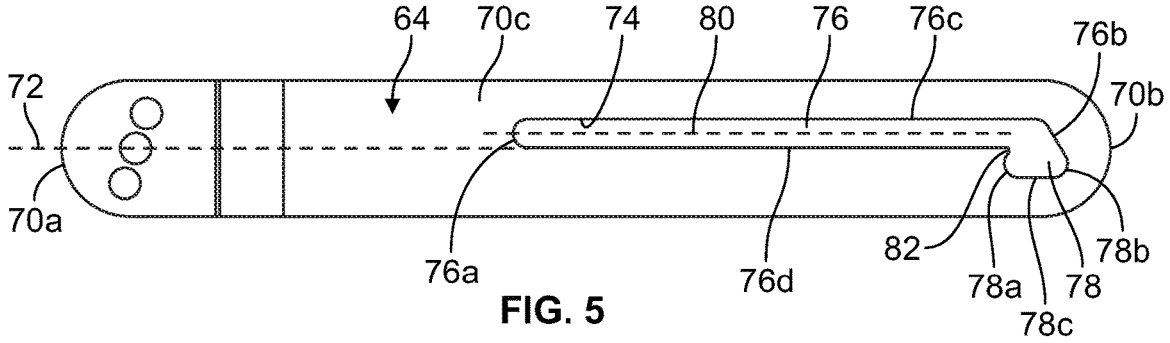
FIG. 5 is a top plan view of a link member of the door stop mechanism.

As shown, the enclosure 24 is formed of a housing 26 with a pair of doors 22*a*, 22*b* mounted thereto which enclose a cavity 28, see FIG. 2, within the housing 26 when the doors 22*a*, 22*b* are in a closed position. The housing 26 and the doors 22*a*, 22*b* may be formed of metal, or plastic, or any other suitable material. In an embodiment, the enclosure 24 has a drawer 30 mounted below the doors 22*a*, 22*b*.

The housing 26 has a rear wall 32, a left side wall 34 extending forwardly from the rear wall 32, a right side wall 36 extending forwardly from the rear wall 32, a top wall 38 extending forwardly from the rear wall 32 and joining the upper ends of the rear wall 32 and the side walls 34, 36 together, a bottom wall 40 extending forwardly from the rear wall 32 and joining the lower ends of the rear wall 32 and the side walls 34, 36 together, and an intermediate wall 42 which is provided between the top and bottom walls 38, 40 and is fixed to the side walls 34, 36 and to the rear wall 32. The intermediate wall 42 forms the bottom wall of the cavity 28 and is referred to as the bottom wall 42 herein. A front surface of each of the left side wall 34, the right side wall 36, the top wall 38 and the bottom wall 42 are flush with each other. The bottom wall 42 has a planar upper surface 44 and a length is defined from a first end of the bottom wall 42 which joins with the left side wall 34 and a second end of the bottom wall 42 which joins with the right side wall 36.

The left door 22*a* is attached to a portion of the left side wall 34 by a hinge 46, and the right door 22*b* is attached to the right side wall 36 by a hinge 48.

The left door 22*a* of the illustrated embodiment is formed from a front wall 50 having a top edge, a bottom edge, a right side edge and a left side edge, a top wall 52 extending inwardly from the top edge of the front wall 50, a bottom wall 54 extending inwardly from the lower edge of the front wall 50, an outer side wall 56 extending inwardly from the left side edge of the front wall 50, an inner side wall 58 extending inwardly from the right side edge of the front wall 50. The bottom wall 54 has a planar lower surface 60 and a length is defined from a first end of the bottom wall 54 which joins with the left side wall 56 and a second end of the bottom wall 54 which joins with the right side wall 58. The hinge 46 is attached to the outer side wall 56 of the door 22*a* and to the left side wall 34 of the housing 26. While the door 22*a* is described with having walls 52, 54, 56, 58, it is to be understood that the door 22*a* can be formed with a thickened front wall 50 and the walls 52, 54, 56, 58 eliminated.

The right door 22*b* of the illustrated embodiment is formed in a like manner except that it is the mirror of the left door 22*a* and thus the specifics are not repeated.

The doors 22*a*, 22*b* mate together when closed to completely close the cavity 28 such that the cavity 28 cannot be accessed from outside of the enclosure 24. When the left door 22*a* is closed, the outer surface of the outer side wall 56 of the left door 22*a* abuts against the inner surface of the left side wall 34 of the housing 26, the outer surface of the top wall 52 of the left door 22*a* abuts against the lower surface of the top wall 38 of the housing 26, the bottom wall 54 of the left door 22*a* abuts against the upper surface 44 of the bottom wall 42 of the housing 26, such that the front surface of the front wall 50 of the left door 22*a* is flush with the front surfaces of the left side wall 34, the top wall 38 and the bottom wall 42 of the housing 26, and the right door 22*b* is closed in an identical manner. The front walls 50 of the doors 22*a*, 22*b* are flush with each other. A locking mechanism 62 is provided to secure the doors 22*a*, 22*b* together.

The door stop mechanism 20 forms a link between the door 22*a* and the housing 26 and is used to hold the door 22*a* in an open position. When a user desires to close the door 22*a*, the door stop mechanism 20 is adjusted as discussed herein, and the door 22*a* can be closed normally around its hinge 46. A second door stop mechanism 20 forms a link between the door 22*b* and the housing 26 and is used to hold the door 22*b* in an open position. In this regard, a door stop mechanism 20 as described herein may be applied to each door of an enclosure, such as enclosure 24, for which it may be desired to have a mechanism enabling maintaining the door in an open position. The door stop mechanisms 20 for the doors 22*a*, 22*b* are identical and for ease in description, the door stop mechanism 20 is described only with regard to door 20*a*.

The door stop mechanism 20 includes a link member 64, a first fastener 66 which pivotally attaches the link member 64 to the door 22*a*, and a second fastener 68 which pivotally attaches the link member 64 to the housing 26.

The link member 64 is formed from an elongated body 70 having first and second ends 70*a*, 70*b*, upper and lower faces 70*c*, 70*d* and a centerline 72 which extends between the ends 70*a*, 70*b*. An elongated slot 74 is provided through a planar section of the body 70 and extends between the upper and lower faces 70*c*, 70*d*. The slot 74 extends along a portion of the length of the body 70. The link member 64 may be formed of metal, or plastic, or any other suitable material.

The slot 74 has a linear portion 76 which extends a predetermined length along a portion of the length of the body 70, and an enlarged opening 78 extending from the linear portion 76 and which is offset from the linear portion 76. The linear portion 76 may be on one side of the centerline 72 and the enlarged opening 78 on the other side of the centerline 72.

The linear portion 76 has a first end surface 76*a*, a second end surface 76*b* and a pair of linear side surfaces 76*c*, 76*d* extending therebetween. The side surfaces 76*c*, 76*d* are parallel to each other. The side surface 76*d* is shorter in length than the side surface 76*c*. A centerline 80 is defined between the opposite end surfaces 76*a*, 76*b*. The centerline 80 of the linear portion 76 extends parallel to, but offset from the centerline 72 of the body 70. The second end surface 76*b* is formed at an angle relative to the centerline 80. The first end surface 76*a* is spaced from the first and second ends 70*a*, 70*b* of the body 70 and may be at the midpoint of the body 70. The second end surface 76*b* is proximate to, but spaced from, the second end 70*b* of the body 70. In an embodiment, the first end surface 76*a* is curved.

The enlarged opening 78 extends from the end surface 76*b* and the side surface 76*d*. The enlarged opening 78 has a first end surface 78*a* extending from the side surface 76*d*, a second end surface 78*b* extending from the end surface 76*b*, and a side surface 78*c* extending therebetween. As shown, the first end surface 78*a* is curved, the side surface 78*c* is linear and parallel to, but offset from, the side surfaces 76*c*, 76*d*, and the second end surface 78*b* is formed at an angle relative to the centerline 80. The second end surface 78*b* is angled relative to the centerline 80 at the same angle as the second end surface 76*b* to forms a continuous angled surface. The enlarged opening 78 is proximate to, but spaced from, the second end 70*b* of the body 70. The angled surfaces 76*b*, 78*b* form an entry into the enlarged opening 78. The first end surface 78*a* forms a detent. As such, a shoulder 82 is formed between the linear portion 76 and the first end surface 78*a*.

The first fastener 66 pivotally attaches the link member 64 to the door 22*a*. The first fastener 66 may be positioned proximate to the junction between the bottom wall 42 and the side wall 34.

In an embodiment and as shown in the drawings, the first fastener 66 is non-rotationally affixed to and extends downwardly from the lower surface 60 of the bottom wall 54 of the door 22*a* and is formed of a shaft 88 attached to the door 22*a* and an enlarged head 90 at an end of the shaft 88. In an embodiment, the enlarged head 90 is integrally formed with the shaft 88. In an embodiment, the enlarged head 90 is separately formed and attached to the shaft 88, for example by threading. The shaft 88 is non-rotationally affixed to the door 22*a* by suitable means, for example by threading or by welding. In this embodiment, the shaft 88 extends through an opening 84 in the body 70 such that the body 70 is sandwiched between the head 90 of the first fastener 66 and the lower surface 60 of the bottom wall 54 of the door 22*a*. The opening 84 is proximate to the first end 70*a* of the body 70. The opening 84 is slightly larger than the shaft 88 such that the link member 64 can rotate around the shaft 88. A washer 92 may be provided between the lower surface 60 of the bottom wall 54 of the door 22*a* and the upper face 70*c* of the body 70. In an embodiment, the first fastener 66 is a screw.

In another embodiment, the first fastener 66 is integrally formed with the body 70 and is formed of a shaft which extends upwardly therefrom. The bottom wall 54 of the door 22*a* has an opening (not shown) therethrough through which the shaft of the first fastener 66 passes. A retainer, such as a nut (not shown), is attached to the free end of the shaft to affix the first fastener 66 to the door 22*a*, but also allowing the door 22*a* to rotate relative to the first fastener 66 and thus the link member 64.

In yet another embodiment, the first fastener 66 is integrally formed with the door 22*a* and is formed of a shaft which extends downwardly therefrom. The shaft extends through the opening 84 in the body 70 such that the body 70 is sandwiched between the head of the first fastener 66 and the lower surface 60 of the bottom wall 54 of the door 22*a*. A retainer, such as a nut (not shown), is attached to the free end of the shaft to affix the first fastener 66 to the door 22*a*, but also allowing the door 22*a* to rotate relative to the first fastener 66 and thus the link member 64.

As shown, the second fastener 68 is affixed to and extends from the upper surface 44 of the bottom wall 42 of the housing 26. The second fastener 68 is spaced a predetermined distance from the junction between the bottom wall 42 and the side wall 34 of the housing 26, such distance being greater than the distance the first fastener 66 is spaced from the side wall 34 of the housing 26 when the door 22*a* is closed. In an embodiment, the second fastener 68 is formed of a shaft 96 and an enlarged head 98. In an embodiment, the enlarged head 98 is integrally formed with the shaft 96. In an embodiment, the enlarged head 98 is separately formed and is attached to the shaft 96, for example by threading. The shaft 96 is affixed to the upper surface 44 of the bottom wall 42 of the housing 26, for example by threading or by welding. The shaft 96 extends upwardly from the bottom wall 42 and extends through the elongated slot 74 in the body 70 such that the body 70 is sandwiched between the enlarged head 98 of the fastener 68 and the bottom wall 42 of the housing 26. A washer 94 may be provided between the lower face 70*d* of the body 70 and the upper surface 44 of the bottom wall 42 of the housing 26. The link member 64 can slide relative to the second fastener 68 along the length of the slot 74 and the link member 64 can pivot or rotate around the second fastener 68. In an embodiment, the second fastener 68 is a screw.

Figure 6A:
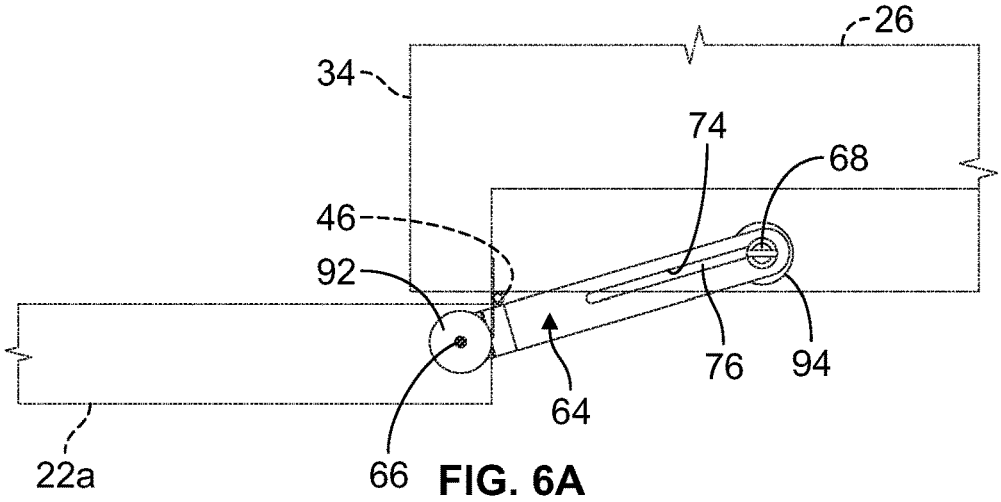
FIG. 6A is a top plan view of the door stop mechanism showing the door in the open position, the enclosure being shown in phantom line.
Figure 6B:
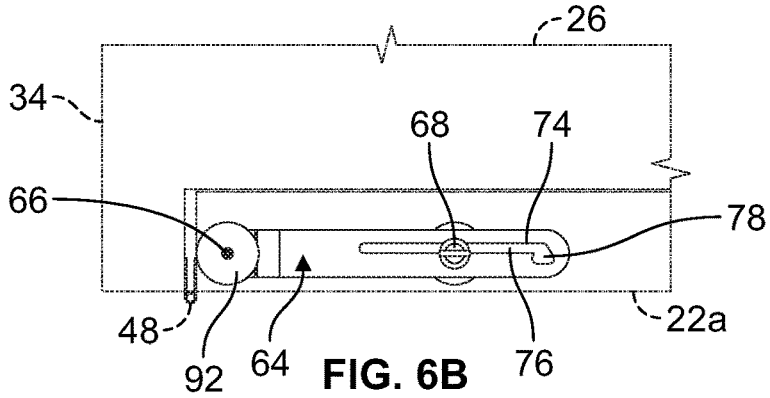
FIG. 6B is a top plan view of the door stop mechanism showing the door in the closed position, the enclosure being shown in phantom line.
Figure 7:
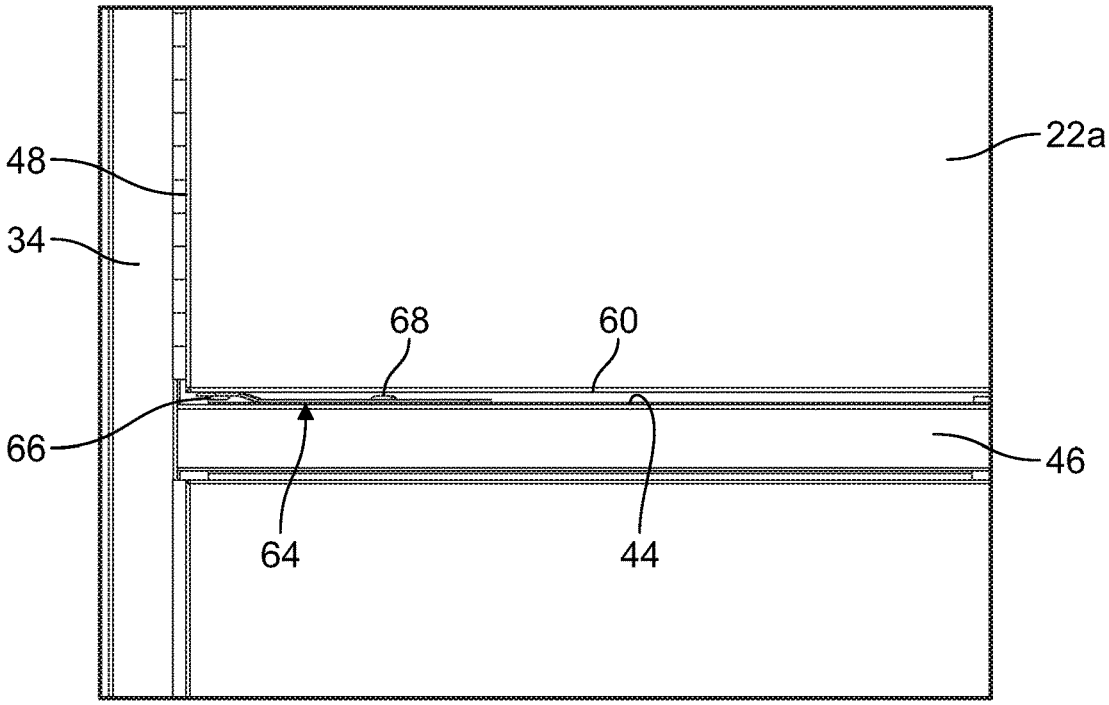
FIG. 7 is a partial front plan view of the enclosure showing the door in the closed position.

When the door 22*a* is in the closed position, the first end 70*a* of the link member 64 is seated between the lower surface 60 of the bottom wall 54 of the door 22*a* and the head 90 of the first fastener 66 and above the upper surface 44 of the bottom wall 42 of the housing 26, and the second end 70*b* of the link member 64 is seated between the head 98 of the second fastener 68 and the upper surface 44 of the bottom wall 42 of the housing 26 and below the lower surface 60 of the bottom wall 42 of the housing 26. In this closed position, the second fastener 68 is within the linear portion 76 and depending upon the length of the slot 74, may be at the first end surface 76*a* of the linear portion 76 or proximate to the first end surface 76*a* of the linear portion 76 as shown in FIG. 6B. The centerlines 72, 80 of the link member 64 are parallel to the length of the bottom walls 42, 54 of the housing 26 and the door 22*a*, and the link member 64 does not extend outwardly from the housing 26 or the door 22*a*.

When the door 22*a* is moved to the open position, the door 22*a* rotates around the hinge 46, and the link member 64 pivots or rotates around the fasteners 66, 68. As the door 22*a* moves outwardly, the link member 64 slides relative to the second fastener 68 such that the position of the second fastener 68 within the linear portion 76 of the slot 74 changes. When the door 22*a* is opened far enough, the angled surface 76*b* engages against the second fastener 68. As the door 22*a* continues to move, the link member 64 moves and the angled surface 78*b* engages against the second fastener 68. The angled surfaces 76*b*, 78*b* promote the movement of the link member 64 relative to the second fastener 68. The user then grasps the link member 64 and manipulates the link member 64 until the second fastener 68 engages against the first end surface 78*a*. The shoulder 82 prevents the second fastener 68 from re-entering into the linear portion 76 of the slot 74. This holds the door 22*a* into the open position until the user desires to close the door 22*a*.

When the user wants to close the door 22*a*, the user grasps the link member 64 and manipulates the link member 64 until the angled surface 78*b* engages the second fastener 68 and then the angled surface 76*b* engages the second fastener 68. The door 22*a* is then rotated around the hinge 46 to close the door 22*a*. As the door 22*a* is being closed, the link member 64 pivots or rotates around the first and second fasteners 66, 68, and the link member 64 slides relative to the second fastener 68 such that the position of the second fastener 68 within the linear portion 76 of the slot 74 changes until the door stop mechanism 20 is in the closed position.

While the door stop mechanism 20 is shown as being attached to the bottom wall 54 of the door 22*a* and the bottom wall 42 of the housing 26, it is to be understood that the door stop mechanism 20 can instead be attached to the top wall 52 of the door 22*a* and to the top wall 38 of the housing 26. The door 22*a* can be rotated such that the hinge 46 is attached to the top wall 38 and the door stop mechanism 20 is attached to the wall 54 of the door 22*a* and to the side wall 34 of the housing 26. While two doors 22*a* are shown, it is to be understood that a single door 22*a* can be provided and the door stop mechanism 20 attaches the door 22*a* to the wall opposite from the hinge.

In an embodiment as shown in FIGS. 2-7, the link member 64 is formed from a first wall 100 which is offset from a second wall 102 by an intermediate wall 104. The walls 100, 102, 104 are integrally formed with each other.

The first wall 100 is planar, has opposite first and second ends 100*a*, 100*b*, a centerline 106 extending between the first and second ends 100*a*, 100*b*, an upper face 100*c* and a lower face 100*d*. The first end 100*a* of the first wall 100 forms the first end 70*a* of the body 70.

The second wall 102 is elongated and planar. The second wall 102 has opposite first and second ends 102*a*, 102*b*, a centerline 108 extending between the first and second ends 102*a*, 102*b*, an upper face 102*c* and a lower face 102*d*. The second end 102*b* of the second wall 102 forms the second end 70*b* of the body 70.

The second wall 102 is parallel to, but offset from, the first wall 100, such that the centerline 108 of the second wall 102 is parallel to, but offset from, the centerline 106 of the first wall 100 and such that the upper face 102*c* of the second wall 102 is offset from the lower face 100*d* of the first wall 100.

Figure 8:
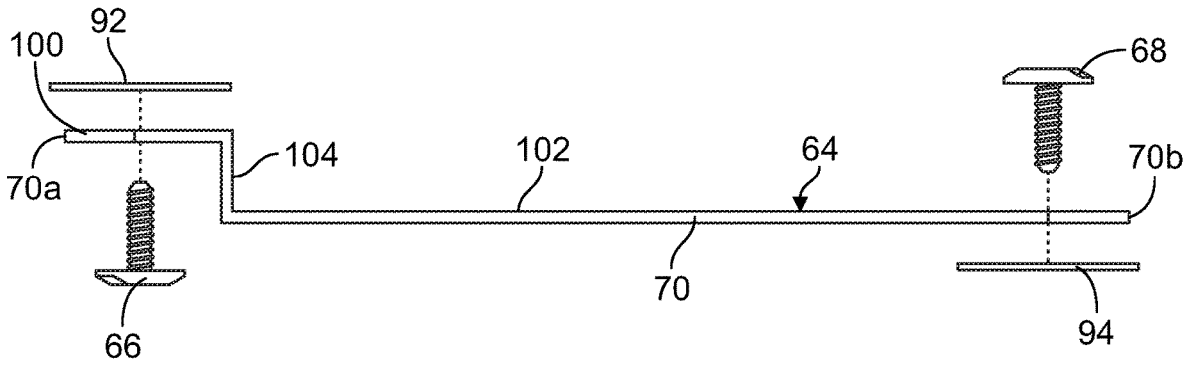
FIG. 8 is a side elevation view of the components of the door stop mechanism, with an alternate link member.

The intermediate wall 104 has opposite first and second ends 104*a*, 104*b*, an upper face 104*c* and a lower face 104*d* The first end 104*a* of the intermediate wall 104 extends from the second end 100*b* of the first wall 100, and the second end 104*b* of the intermediate wall 104 extends from the first end 102*a* of the second wall 102. In an embodiment, the intermediate wall 104 is formed of an angled wall as shown in FIGS. 2-7. In an embodiment, the intermediate wall 104 is formed from a wall that is perpendicular to the first and second walls 100, 102 as shown in FIG. 8. In an embodiment, the intermediate wall 104 is formed from a plurality of walls which may be angled. In an embodiment, the intermediate wall 104 may be formed from a plurality of steps.

The first wall 100 has the first fastener 66 attached thereto as described herein.

The second wall 102 has the elongated slot 74 therein which extends between the upper and lower faces 102*c*, 102*d*.

With these embodiments, the heads 90, 98 of the fasteners 66, 68 are positioned below the first wall 100 and above the second wall 102 in order to reduce the height of the door stop mechanism 20 between the door 22*a* and the housing 26.

Figure 9:
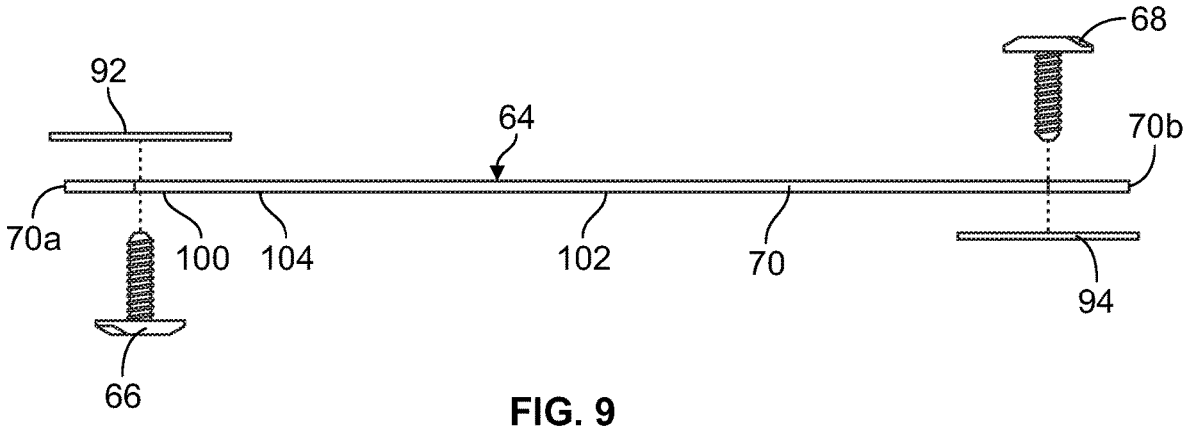
FIG. 9 is a side elevation view of the components of the door stop mechanism, with a yet another alternate link member.

In an embodiment as shown in FIG. 9, the link member 64 is planar from end 70*a* to end 70*b*, such that the walls 100, 102, 104 are aligned with each other.

While particular embodiments are illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

What is claimed is:

1. An assembly comprising:

an enclosure comprising a housing and a door hingedly attached to the housing, the housing comprising a rear wall, a first side wall extending forwardly from the rear wall, a second side wall extending forwardly from the rear wall, a top wall extending forwardly from the rear wall and joining upper ends of the rear wall and side walls together, a bottom wall extending forwardly from the rear wall and joining lower ends of the rear wall and side walls together and thereby forming a cavity, the door being configured to be moved into an open position to expose the cavity and configured to be moved into a closed position to close the cavity; and a door stop mechanism configured to hold the door in the open position relative to the housing, the door stop mechanism comprising:

a link member pivotally connected to the door and to the housing, the link member having first and second opposite ends having a length defined therebetween, opposite first and second faces and a centerline defined between the opposite ends, at least a portion of the link member being linear and planar which defines a first portion, an elongated slot provided through the first portion of the link member from the first face to the second face, the slot having first and second closed ends, the slot comprising a linear portion having first and second opposite ends and having a length and a centerline defined therebetween, the slot further comprising an enlarged opening proximate to the second end of the linear portion, the enlarged opening being completely offset to one side of the centerline of the linear portion, the first end of the linear portion being spaced from the first end of the link member and forming the first closed end of the slot, the second end of the linear portion and the enlarged opening being proximate to, but spaced from, the second end of the link member and forming the second closed end of the slot, the centerlines of the link member and the linear portion are parallel to each other, but offset from each other, a first fastener fixedly attached to one of the link member and the door and being rotatably attached to the other of the link member and the door, the first fastener being proximate to, but spaced from, the first end of the link member, and a second fastener fixedly attached to one of the top wall of the housing and the bottom wall of the housing, the second fastener mounted in the slot and slidable within the slot and configured to be positioned within the linear portion of the slot when the door is in the closed position and configured to be positioned within the enlarged opening of the slot when the door is in the open position, the link member being rotatable around the second fastener.

2. An assembly comprising:

an enclosure comprising a housing and a door hingedly attached to the housing, the housing comprising a rear wall, a first side wall extending forwardly from the rear wall, a second side wall extending forwardly from the rear wall, a top wall extending forwardly from the rear wall and joining upper ends of the rear wall and side walls together, a bottom wall extending forwardly from the rear wall and joining lower ends of the rear wall and side walls together and thereby forming a cavity, the door being configured to be moved into an open position to expose the cavity and configured to be moved into a closed position to close the cavity; and a door stop mechanism configured to hold the door in the open position relative to the housing, the door stop mechanism comprising:

a link member comprising first and second walls which are offset from each other by an intermediate wall, the link member being pivotally connected to the door and to the housing, the link member having first and second opposite ends having a length defined therebetween, opposite first and second faces and a centerline defined between the opposite ends, the second wall being linear and planar, an elongated slot provided through the second wall of the link member from the first face to the second face, the slot having first and second closed ends, the slot comprising a linear portion having first and second opposite ends and having a length and a centerline defined therebetween, the slot further comprising an enlarged opening proximate to the second end of the linear portion, the enlarged opening being completely offset to one side of the centerline of the linear portion, the first end of the linear portion being spaced from the first end of the link member and forming the first closed end of the slot, the second end of the linear portion and the enlarged opening being proximate to, but spaced from, the second end of the link member and forming the second closed end of the slot, a first fastener fixedly attached to one of the link member and the door and being rotatably attached to the other of the link member and the door, the first fastener being proximate to, but spaced from, the first end of the link member, and a second fastener fixedly attached to one of the top wall of the housing and the bottom wall of the housing, the second fastener mounted in the slot and slidable within the slot and configured to be positioned within the linear portion of the slot when the door is in the closed position and configured to be positioned within the enlarged opening of the slot when the door is in the open position, the link member being rotatable around the second fastener.

3. The assembly of claim 2, wherein the first wall has opposite first and second faces and opposite ends, wherein a length and a centerline of the first wall is defined between the opposite ends, the first wall extending from the first end of the link member, and the second wall having opposite first and second faces and opposite ends, wherein a length and a centerline of the second wall is defined between the opposite ends of the second wall, the second wall extending from the second end of the link member, the intermediate wall connecting the first wall to the second wall such that the centerlines of the first and second walls are offset from each other.

4. The assembly of claim 3, wherein the centerlines of the first and second walls are parallel to each other.

5. The assembly of claim 3, wherein the intermediate wall is offset from the first wall at a first angle and is offset from the second wall at a second angle.

6. The assembly of claim 3, wherein each of the first and second fasteners comprises a shaft having an enlarged head at an end thereof, the enlarged head of the first fastener being engaged against the first wall and the enlarged head of the second fastener being engaged against the second wall.

7. An assembly comprising:

an enclosure comprising a housing and a door hingedly attached to the housing, the housing comprising a rear wall, a first side wall extending forwardly from the rear wall, a second side wall extending forwardly from the rear wall, a top wall extending forwardly from the rear wall and joining upper ends of the rear wall and side walls together, a bottom wall extending forwardly from the rear wall and joining lower ends of the rear wall and side walls together and thereby forming a cavity, the door being configured to be moved into an open position to expose the cavity and configured to be moved into a closed position to close the cavity; and a door stop mechanism configured to hold the door in the open position relative to the housing, the door stop mechanism comprising:

a link member pivotally connected to the door and to the housing, the link member having first and second opposite ends having a length defined therebetween, opposite first and second faces and a centerline defined between the opposite ends, at least a portion of the link member being linear and planar which defines a first portion, an elongated slot provided through the first portion of the link member from the first face to the second face, the slot having first and second closed ends, the slot comprises a linear portion having first and second opposite ends and having a length and a centerline defined therebetween, the first end of the linear portion being spaced from the first end of the link member and forming the first closed end of the slot, the second end of the linear portion is formed of an end surface which is angled relative to the centerline of the linear portion at an angle greater than 90 degrees, the slot further comprises an enlarged opening proximate to the second end of the linear portion, the enlarged opening being completely offset to one side of the centerline of the linear portion, the second end of the linear portion and the enlarged opening being proximate to, but spaced from, the second end of the link member and forming the second closed end of the slot, and the enlarged opening comprises an end surface extending directly from the angled end surface of the linear portion, the end surface of the enlarged opening being angled relative to the centerline of the linear portion at an angle, the end surface of the linear portion and the end surface of the enlarged opening extending at the same angle, a first fastener fixedly attached to one of the link member and the door and being rotatably attached to the other of the link member and the door, the first fastener being proximate to, but spaced from, the first end of the link member, and a second fastener fixedly attached to one of the top wall of the housing and the bottom wall of the housing, the second fastener mounted in the slot and slidable within the slot and configured to be positioned within the linear portion of the slot when the door is in the closed position and configured to be positioned within the enlarged opening of the slot when the door is in the open position, the link member being rotatable around the second fastener.

8. The assembly of claim 7, wherein the enlarged opening further comprises a linear side surface extending at an angle relative to the end surface of the enlarged opening and a rounded surface extending from the linear side surface of the enlarged opening to the linear portion.

9. The assembly of claim 1, wherein the enclosure is a job storage box.

10. The assembly of claim 1, wherein each of the first and second fasteners comprises a shaft having an enlarged head at an end thereof, the enlarged head of the first fastener being engaged against the link member and the enlarged head of the second fastener being engaged against the link member.

11. The assembly of claim 10, wherein the first and second fasteners are screws.

12. The assembly of claim 1, wherein the first and second fasteners are screws.

13. The assembly of claim 1, further comprising a first washer mounted between the link member and the housing, and a second washer mounted between the link member and the door.

14. The assembly of claim 1, wherein the link member is formed of metal.

15. The assembly of claim 2, wherein the first fastener is fixedly attached to the door and extends through an aperture in the first wall.

16. The assembly of claim 1, wherein the first end of the slot is at a midpoint of the link member.

17. The assembly of claim 1, wherein the link member is linear and planar from the first end of the link member to the second end of the link member.

18. The assembly of claim 5, wherein the first angle is 90 degrees and the second angle is 90 degrees.

19. The assembly of claim 1, wherein the centerline of the link member is parallel to a length of a bottom wall of the door when the door is in the closed position.

20. An assembly comprising:

an enclosure comprising a housing and a door hingedly attached to the housing, the housing comprising a rear wall, a first side wall extending forwardly from the rear wall, a second side wall extending forwardly from the rear wall, a top wall extending forwardly from the rear wall and joining upper ends of the rear wall and side walls together, a bottom wall extending forwardly from the rear wall and joining lower ends of the rear wall and side walls together and thereby forming a cavity, the door being configured to be moved into an open position to expose the cavity and configured to be moved into a closed position to close the cavity; and a door stop mechanism configured to hold the door in the open position relative to the housing, the door stop mechanism comprising:

a link member pivotally connected to the door and to the housing, the link member having first and second opposite ends having a length defined therebetween, opposite first and second faces and a centerline defined between the opposite ends, at least a portion of the link member being linear and planar which defines a first portion, an elongated slot provided through the first portion of the link member from the first face to the second face, the slot having first and second closed ends, the slot comprising a linear portion having first and second opposite ends and having a length and a centerline defined therebetween, the linear portion comprising a first end surface at the first end thereof, a second end surface at the second end thereof, and first and second side surfaces extending between the end surfaces, the side surfaces being parallel to each other and parallel to the centerline of the linear portion, the second end surface being angled relative to the centerline of the linear portion and to the side surfaces at an angle greater than 90 degrees, the first end surface of the linear portion being spaced from the first end of the link member and forming the first closed end of the slot, the slot further comprising an enlarged opening proximate to the second end of the linear portion, the enlarged opening being completely offset to one side of the centerline of the linear portion, the enlarged opening comprising an end surface extending directly from the second end surface of the linear portion, the end surface of the enlarged opening being angled relative to the centerline of the linear portion and to the side surfaces, the second end surface of the linear portion and the end surface of the enlarged opening extending at the same angle, the second end of the linear portion and the enlarged opening being proximate to, but spaced from, the second end of the link member and forming the second closed end of the slot, a first fastener fixedly attached to one of the link member and the door and being rotatably attached to the other of the link member and the door, the first fastener being proximate to, but spaced from, the first end of the link member, and a second fastener fixedly attached to one of the top wall of the housing and the bottom wall of the housing, the second fastener mounted in the slot and slidable within the slot and configured to be positioned within the linear portion of the slot when the door is in the closed position and configured to be positioned within the enlarged opening of the slot when the door is in the open position, the link member being rotatable around the second fastener.

21. The assembly of claim 20, wherein the enlarged opening further comprises a linear side surface extending at from the end surface thereof, the linear side surface of the enlarged opening being parallel to the side surfaces of the linear portion, and a rounded surface extending from the linear side surface of the enlarged opening to the second side surface of the linear portion.

22. The assembly of claim 1, wherein the link member comprises first and second walls which are offset from each other by an intermediate wall, wherein the second wall forms the first portion.

* * * * *